United States Patent [19]

Leflet

[11] Patent Number: 4,885,857

[45] Date of Patent: Dec. 12, 1989

[54] TWO-POSITION SIGNAL DEVICE

[76] Inventor: David Leflet, 8610 NW. 178th St., Miami, Fla. 33015

[21] Appl. No.: 311,043

[22] Filed: Feb. 17, 1989

Related U.S. Application Data

[63] Continuation-in-part of Ser. No. 165,976, Mar. 9, 1988.

[51] Int. Cl.[4] ..... G09F 19/00

[52] U.S. Cl. ..... 40/533; 40/359; 116/319

[58] Field of Search ..... 16/319, 306, 380, 386; 40/486, 492, 530, 533, 535, 359, 324, 447, 450, 449, 536; 232/34, 35, 37

[56] References Cited

U.S. PATENT DOCUMENTS

| | | | |
|---|---|---|---|
| 936,277 | 10/1909 | Kilmer et al. | 116/319 |
| 1,083,706 | 1/1914 | Schmachtenberger | 40/533 |
| 1,611,645 | 12/1926 | Kingman | 116/319 |
| 2,556,449 | 6/1951 | Scheeler | 16/380 |
| 3,002,491 | 10/1961 | Bachman | 116/319 |
| 3,219,009 | 11/1965 | Olsen | 40/359 |
| 3,916,547 | 11/1975 | Ryder | 40/533 |
| 4,829,686 | 5/1989 | Endicott | 40/492 |

*Primary Examiner*—Cary E. Stone

[57] ABSTRACT

The novel two-position signal device comprises a generally rectangular base plate, a pair of substantially parallel flanges upstanding along opposite edges of the base plate, a signal panel pivotally mounted on the flanges and adapted to be rotated between two different signaling positions against the base plate between the flanges.

21 Claims, 5 Drawing Sheets

TWO-POSITION SIGNAL DEVICE

CROSS-REFERENCE TO RELATED APPLICATIONS

This is a continuation-in-part of patent application Ser. No. 165,976, filed Mar. 9, 1988 by the applicant named herein.

BACKGROUND OF THE INVENTION

1. Field Of The Invention

This invention relates to a novel two-position signal device which is adapted to be attached to a primary object such as an office file, an item of manufacture, a pill bottle, or like items. It may be used to indicate the status of an office file, open or closed; the status of a manufactured item, complete or incomplete; or attached to a pill bottle to indicate the number of pills taken within a givien period of time. It can be used to indicate the status of many different items by such words as yes/no, opened/closed, in/out, on/off, stop/go, and for sale/sold. As it may be seen, there are an infinite number of signaling uses for the present invention. In addition to words; other signalling media, such as letters, number, symbols or color codes such as red/green can also be used to indicate status change.

2. Description Of The Prior Art

There are many kinds of signals that may be used on the records in a business office. For example, there are colored tags that may be adhered to the margins of office files to indicate the category of each file. Also, there are colored metal flags, which can be clipped onto file cards, for indicating the status or category of the information on each card. These prior signal devices must constantly be moved and/or changed to keep them up to date. For example, if a response is due, a red label or flag may be attached. If the response has been sent, the label or flag may have to be changed to green. Similarly, a green label or flag may indicate that an item is "for sale" or "not inventoried" and must be changed to a red label or flag to indicate that the item has been sold or has been inventoried.

There are also large signs, such as are described in U.S. Pat. Nos. 1,083,706 to O. Schmachtenberger; 1,653,325 to E. Watts; 2,501,044 to S. J. Gianelloni, Jr.; 4,318,238 to A. J. Macarle, Jr.; and 4,597,209 to M. E. Hukill, which are signal devices used to indicate the status or category of a situation. Such signs may have two or more positions to indicate different information to a viewer. These signs may be mounted on a building, or on a heavy standard for placing in a roadway. Such signs are heavy and bulky and completely impractical for use in a home or business office environment, especially with respect to office records and the like. Also, there are mnemonic aid devices, such as are disclosed in U.S. Pat. Nos. 1,611,645 to R. B. Kingman and 3,219,009 to E. J. Olsen which are not well adapted for attachment to an office file or the like.

OBJECTS OF THE INVENTION

An object of this invention is to provide a novel two-position signal device adapted for use with a primary object such as an office file, an item of manufacture, a pill bottle, or the like. This invention provides a convenient and easy way to remind one of the status of a file, project, or situation; or to advise others of the same information.

Another object is to provide a signal device that can be attached to a primary object and can be changed from one signal position to the other with the flip of a finger.

A further object is to provide a novel two position signal device that is small, lightweight, low in cost, and convenient to use.

Still another object is to provide a novel twoposition signal device that can be made entirely of a synthetic plastic material and can be adhered to a primary object such as an office file with an adhesive, or by a pin, clip or staple.

SUMMARY OF THE INVENTION

The novel signal device comprises a generally rectangular base plate adapted to be attached to a primary object such as an office file, a pair of substantially parallel flanges upstanding along opposite edges of the base plate, a signal panel pivotally mounted on said flanges and adapted to be rotated between two different signaling positions against the base plate between the flanges, means for releasably holding the signal panel in each of the two signalling positions by a press fit between the flanges, and means, such as a pressure-sensitive adhesive on the back of the base plate, for attaching the base plate to an office file or other primary object.

In the preferred embodiments, the signal panel is pivoted along one side thereof to the centers of the two flanges, so that the panel press-fits between the flanges against the base plate in each of the two signalling positions of rotation. The flanges and edges of the panel have mating bumps and detents, or pairs of bumps, for releasably holding the panel by a press fit in each of the two signalling positions. Also, the panel, in its signalling positions, extends beyond the base plate, so that it can easily be engaged manually and flipped to its opposite position.

BRIEF DESCRIPTION OF THE DRAWINGS

FIG. 1 is an elevational view of a first embodiment of the novel device.

DETAILED DESCRIPTION OF THE INVENTION

INCLUDING THE PREFERRED EMBODIMENT

Figure 2:
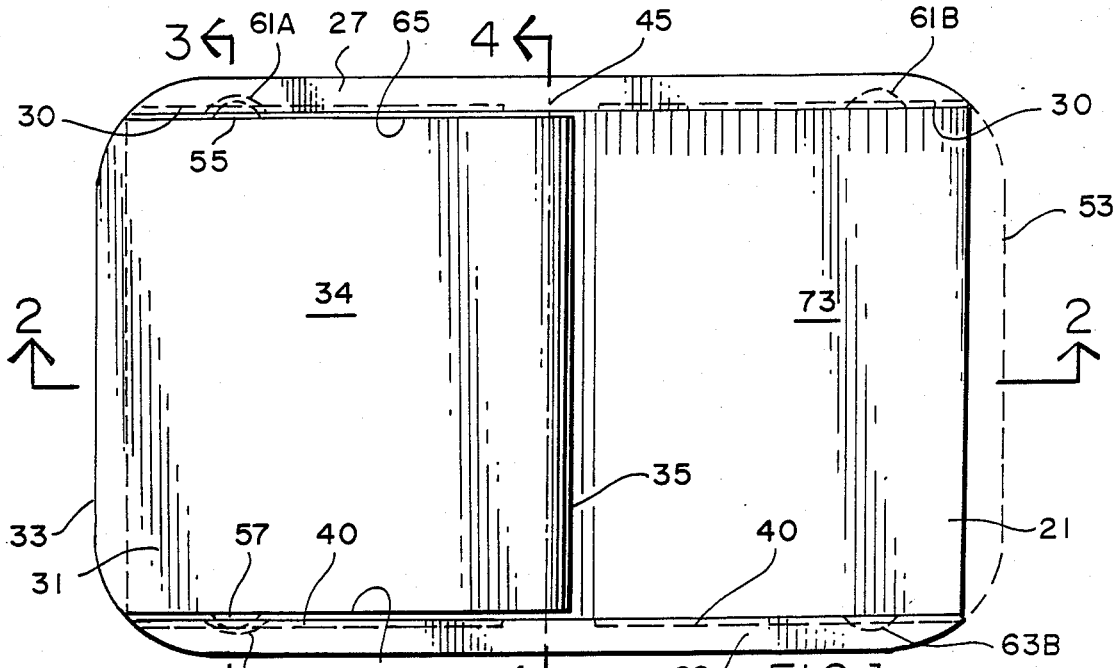
FIG. 2 is a sectional view of the first embodiment viewed along section line 2—2 of FIG. 1.

The following description of some of the preferred embodiments of the concepts of this invention is made in reference to the accompanying figures. Where an individual structural element is depicted in more than one figure, it is assigned a common reference numeral for simplification or identification and understanding.

Figure 3:
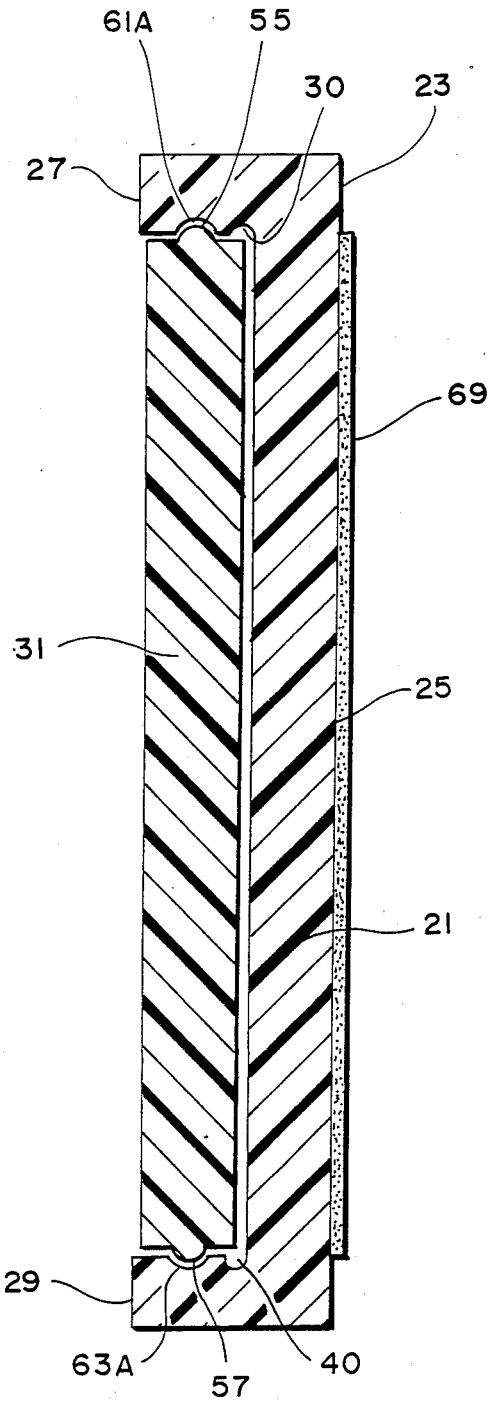
FIG. 3 is a sectional view of the first embodiment viewed along section line 3—3 of FIG. 1.
Figure 4:
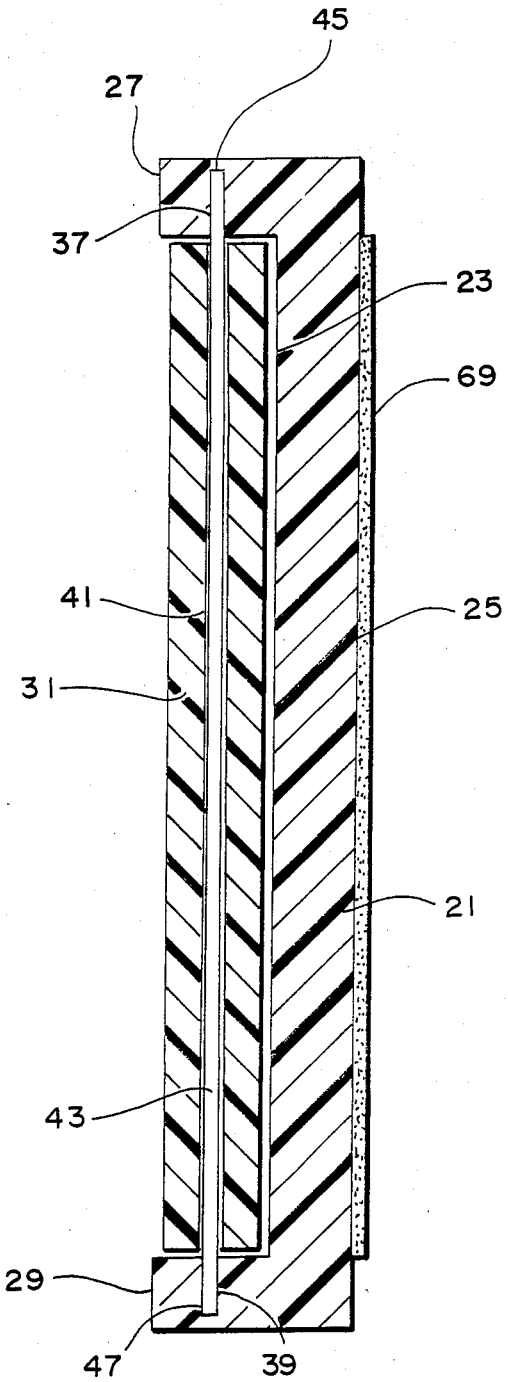
FIG. 4 is a sectional view of the first embodiment viewed along section line 4—4 for FIG. 1.
Figure 6:
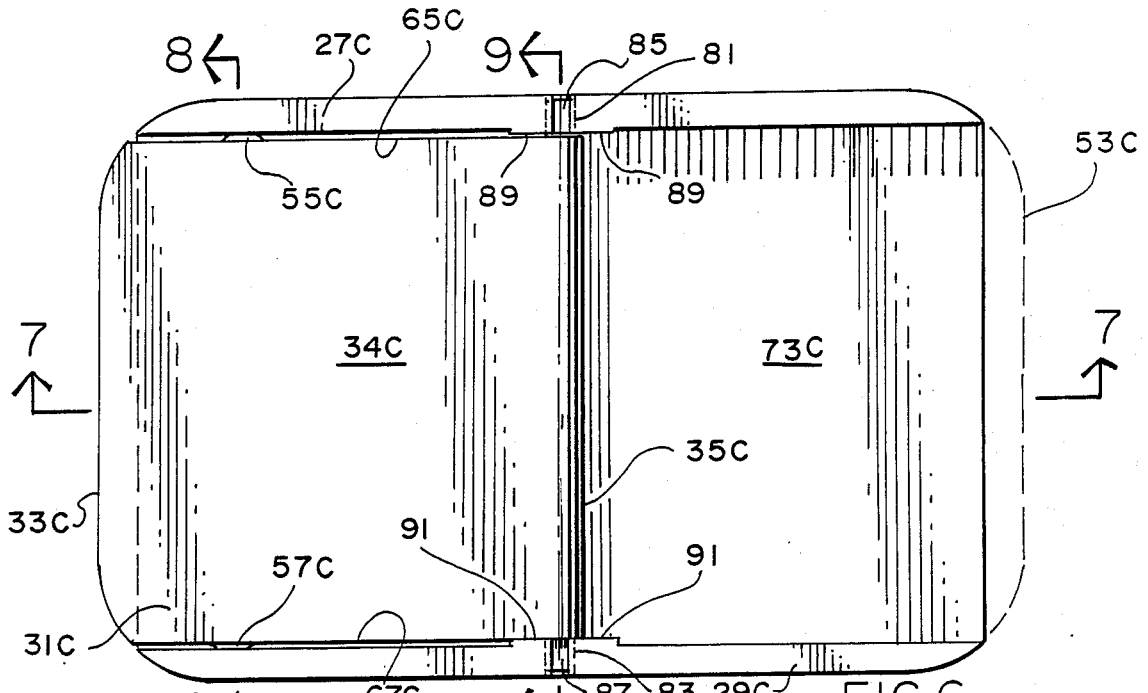
FIG. 6 is an elevational view of a second embodiment of the novel device.

The first embodiment of the novel device shown in FIGS. 1 to 5 comprises a substantially rectangular base plate 21 having rounded corners, a major front surface 23 and an opposite major back surface 25 (FIGS. 2 to 4). An upper flange 27 is upstanding along the upper edge of the front surface 23 and a lower flange 29 is upstanding along the lower edge of the front surface 23, both flanges 27 and 29 being integral with the base plate 21 and facing one another in substantially parallel relationship. The upper flange 27 contains a first base slot 30 which is adjacent to the front surface 23 and the lower flange 29 contains a second base slot 40 which is also adjacent to the front surfact 23. The base slots 30 and 40 are not continuous throughout the flanges 27 and 29 but rather terminate at the proximal end 35 of the signal panel 31.

A signal panel 31 is pivotally mounted to the upper and lower flanges 27 and 29, which are integral with the base plate 21. The signal panel 31 is generally rectangular and has a height such that it would otherwise fit loosely between the upper and lower flanges 27 and 29 without the releasable holding means described below. The width of the signal panel 31 extends between a distal end 33 and a proximal end 35 which houses the pivotal mounting. The signal panel 31 has major opposed panel surfaces 32 and 34 denoting each display area of the signal panel 31.

The pivotal mounting for the signal panel 31 includes an upper flange aperture 37 centrally located in the upper flange 27, a lower flange aperture 39 centrally located in the lower flange 29, and a signal panel aperture 41 through the signal panel 31 parallel to and close to the proximal end 35. A pin 43, which may be of metal or plastic filament, but is preferably plastic, extends into the upper aperture 37, through the panel aperture 41 and into the lower aperture 39. The pin 43 has an enlarged upper end 45 and an enlarged lower end 47 (produced by heating each end to cause it to ball up) to prevent the pin 43 from slipping out of the apertures 37, 39, and 41. Alternatively, the pin 43 may be embedded in the upper and lower flanges 27 and 29, respectively (not shown). The signal panel 31 can rotate around the pin 43 between a first signalling position 51 and a second signalling position 53 (both positions are shown with phantom lines in FIG. 5). In both the first and second signalling positions 51 and 53, the signal panel 31 is adjacent the front surface 23 of the base plate 21 and is also press fit between the upper and lower flanges 27 and 29.

The proximal end 35 of the signal panel 31 is rounded, as shown in FIG. 2, to increase the clearance between the base plate 21 and the proximal end 35 of the signal panel 31. Also, the width of the signal panel 31 is such that the distal end 33 of the signal panel 31 extends beyond the edges of the base plate 21 when the signal panel 31 is in each of its signalling positions 51 and 53. This permits the user to engage the distal end 33 easily with a finger and to flip the signal panel 31 into and out of each of the signalling positions.

Figure 5:
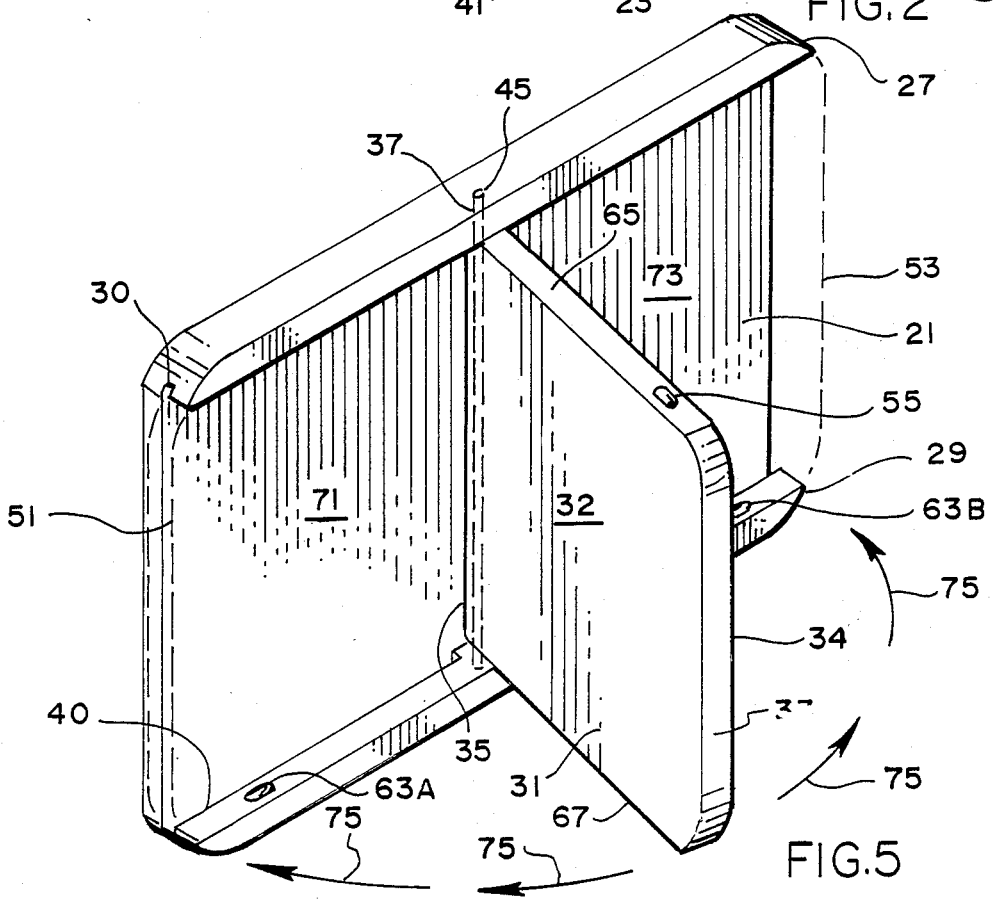
FIG. 5 is a perspective view of the first embodiment with the signal panel being rotated from one signalling position to the other signalling position.
Figure 2A:
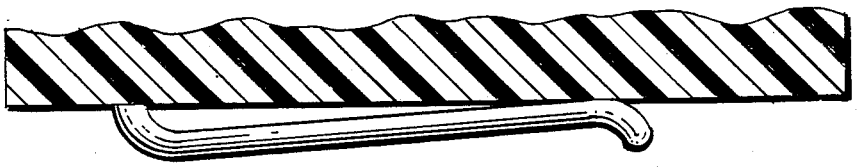
FIG. 2A is a fragmented side view of FIG. 2 showing a clip.
Figure 2B:
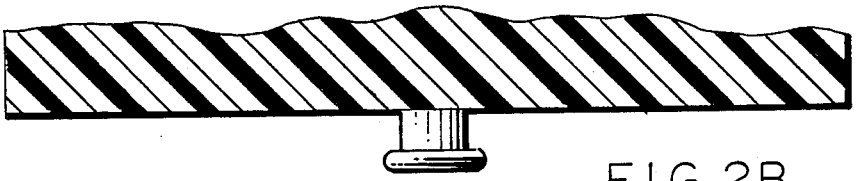
FIG. 2B is a fragmented side view of FIG. 2 showing a pin.
Figure 2C:
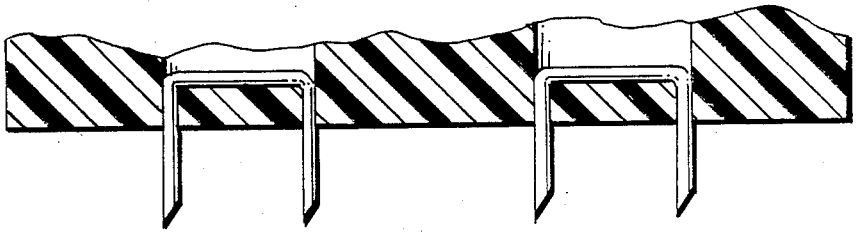
FIG. 2C is a fragmented side view of FIG. 2 showing a staple.

The novel device also has means for releasably holding the signal panel in each of the two signalling positions 51 and 53 between the upper and lower flanges 27 and 29 by a press fit. The releasable holding means may be mating pairs of a bump and a detent. As shown in FIGS. 1 to 5, the signal panel 31 has an upper bump 55 on its upper intermediate edge 65 and a lower bump 57 on its lower intermediate edge 67. There are mating upper detents 61A and 61B in the upper facing edge of the upper flange 27 for mating with the upper bump 55 in each of the first and second positions 51 and 53 respectively, as shown in FIG. 1. There are mating lower detents 63A and 63B in the lower facing edge of the lower flange 29 for mating with the lower bump 57 in each of the first and second positions 51 and 53 respectively, as shown in FIGS. 1 and 5.

The first embodiment of the novel device also has a means for attaching the base plate 21 to the surface of a primary object, such as an office file, a file folder, a pill bottle, an item of manufacture, or of a similar article for which similar alternate information is desired. As shown in FIGS. 2 to 4, the back surface 25 of the base plate 21 carries a layer 69 of a pressure-sensitive adhesive. Other types of adhesive can be used instead. Also, the base plate 21 can include a clip, pin or staple instead of an adhesive, for attaching the novel device.

The base plate 21 and the signal panel are each made of a relatively rigid plastic material by any of the methods used for fabricating small items. The base plate 21 of this preferred embodiment is about 50 mm wide, 25 mm high and 2.5 mm thick. The flanges 27 and 29 are each about 2.5 mm high and stand out about 3.0 from the front surface 23. The signal panel 31 is about 20 mm high, about 30 mm wide and 2.5 mm thick. Of course, the novel device can be made in other dimensions and other proportions. Also, the base plate 21 may be flexible enough to conform to and attach to primary objects which have curved surfaces.

It will be noted that the signal panel 31 covers a first area 71 or a second area 73 of the front surface 23 when the signal panel 31 is in its first and second signalling positions respectively. FIG. 5 shows by the arrows 75, the signal panel 31 being moved from its first position 51 covering the first area 71 to its second position 53 covering the second area 73. Of course, the signal panel can be moved from its second position 53 to its first position 51, and can be moved back and forth as many times as desired. In each position, the signal panel 31 is releasably held by a press fit by the mating pairs of bumps and detents between the flanges 27 and 29 and the intermediate panel edges 65 and 67.

The first and second areas 71 and 73 and/or the signal panel surfaces 32 and 34 have different contrasting colors such as red and green respectively, and/or may carry other contrasting signalling media, such as different letters, numbers or symbols, to indicate two different conditions or statuses as described above. In use, the first embodiment of the novel device is attached to the item of interest and the signal panel 31 is flipped to a position so that the device indicates the desired condition or status. When the condition or status changes, the signal panel 31 is flipped to the other position to indicate the change. The flip of the panel is accomplished without removing the device from the item and can be done manually with the flip of a finger. The color fields, letters, numbers and/or symbols may be carried directly on the surfaces mentioned, or the surfaces mentioned may carry transparent pockets into which the desired information can be inserted and removed. Further, the base slots 30 and 40 may be used to insert desired information on sheet-like material. Also, the surfaces mentioned can be adapted to receive a graphic notation applied by the user.

Figure 7:
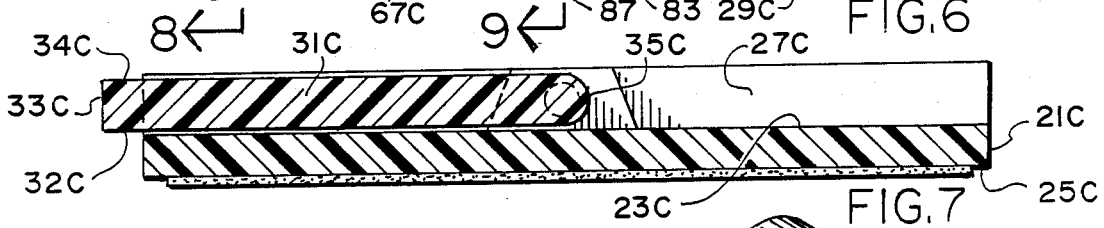
FIG. 7 is a sectional view of the second embodiment viewed along section line 7—7 of FIG. 6.
Figure 8:
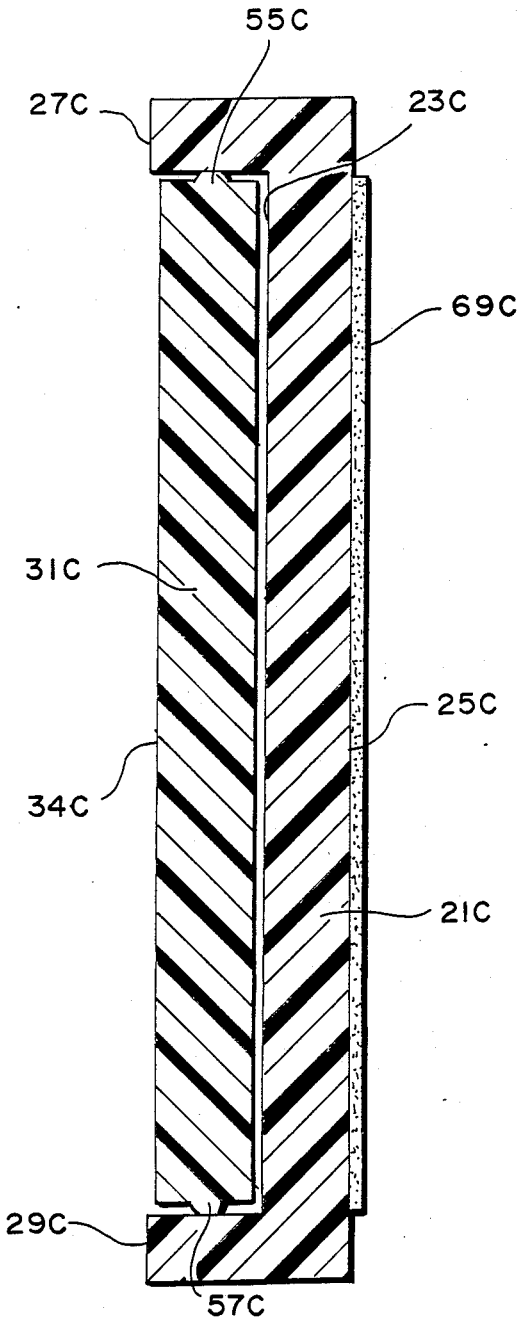
FIG. 8 is a sectional view of the second embodiment viewed along section line 8—8 of FIG. 6.
Figure 9:
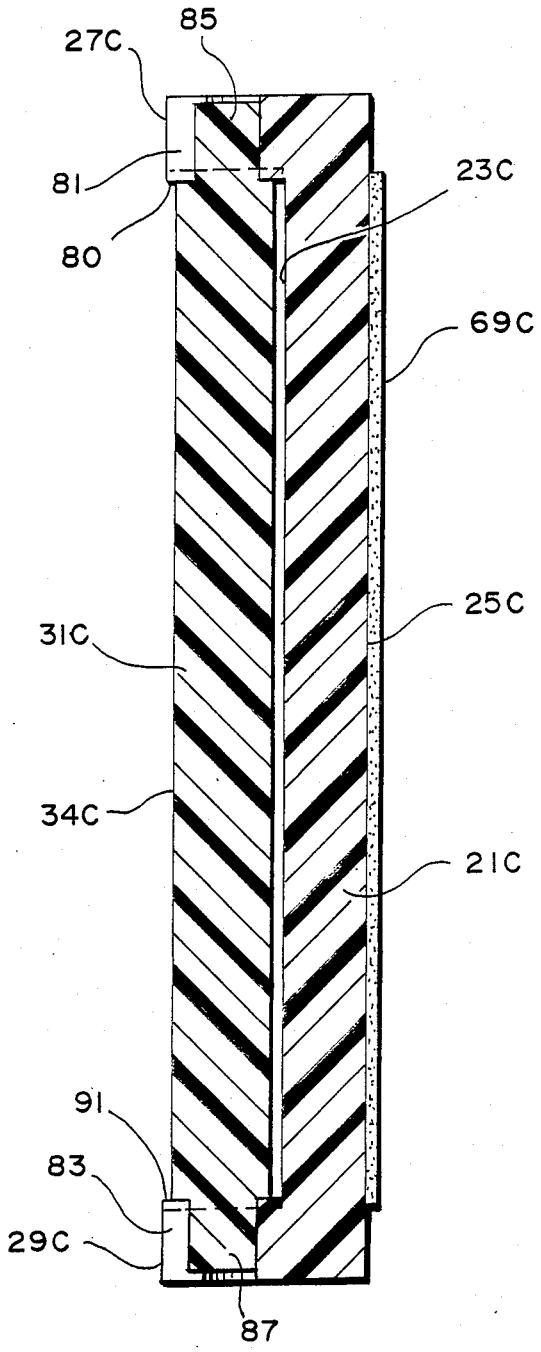
FIG. 9 is a sectional view of the second embodiment viewed along section line 9—9 for FIG. 6.

The second embodiment of the novel device, shown in FIGS. 6 to 10, is similar to the first embodiment and similar structures with similar functions have the same reference numerals followed by the letter "C." The second embodiment comprises a substantially rectangular base plate 21C having rounded corners, a major front surface 23C and an opposite major back surface 25C (FIGS. 7 to 9). An upper flange 27C is upstanding along the upper edge of the front surface 23C and a lower flange 29C is upstanding along the lower edge of the front surface 23C, both flanges 27C and 29C being integral with the base plate 21C and facing one another in a substantially parallel relationship.

A signal panel 31C is pivotally mounted to the upper and lower flanges 27C and 29C, which are integral with the base plate 21C. The signal panel 31C is generally rectangular and has a height such that it would fit loosely between the upper and lower flanges 27C and 29C without the releasable holding means described below. The width of the signal panel 31C extends between a distal end 33C and a proximal end 35C which houses the pivotal mounting. The signal panel 31C has major opposed panel surfaces 32C and 34C denoting each display area of the signal panel 31C.

The pivotal mounting for the signal panel 31C includes an upper pivot slot 81 centrally located in the upper flange 27C and a lower pivot slot 83 centrally located in the lower flange 29C with the two pivot slots 81 and 83 opposite one another. An upper pivot rod 85 and a lower pivot rod 87, each integral with the signal panel 31C, extends from each of the intermediate panel edges 65C and 67C adjacent to the proximal panel edge 35C. Each of the upper and lower rods 85 and 87 is pressed into the upper and lower pivot slots 81 and 83 respectively. The signal panel 31C and pivot rods 85 and 87 can rotate in the pivot slots 81 an 83 between a first signalling position 51C and a second signalling position 53C (both positions are shown with phantom lines in FIG. 10). In both the first and second signalling positions 51C and 53C, the signal panel 31C is adjacent the front surface 23C of the base plate 21C and is also press fit between the upper and lower flanges 27C and 29C.

The proximal end 35C of the signal panel 31C is rounded, as shown in FIG. 7, to increase the clearance between the base plate 21C and the proximal end 35C of the signal panel 31C. Also, the width of the signal panel 31C is such that the distal end 33C of the signal panel 31C extends beyond the edges of the base plate 21C when the signal panel 31C is in its signalling positions 51C and 53C. This permits the user to engage the distal end 33C easily with a finger and to flip the signal panel 31C fron one signalling position to the other signalling position.

Figure 10:
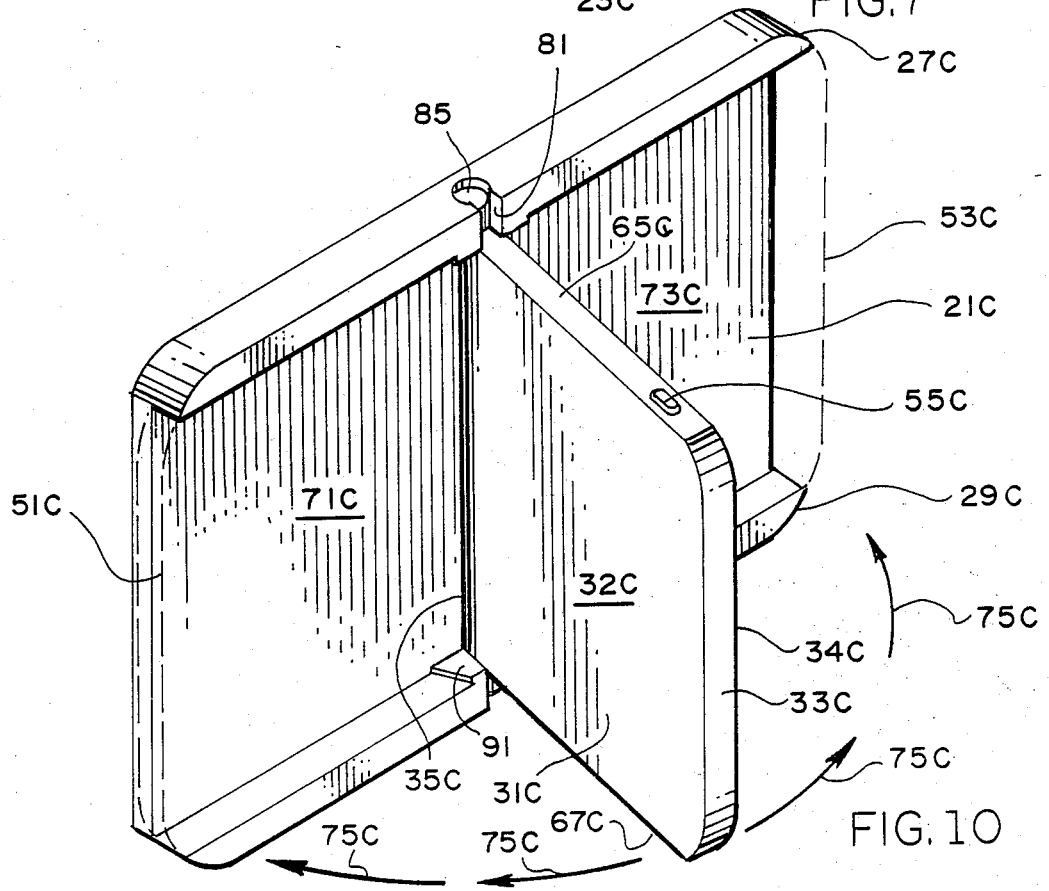
FIG. 10 is a perspective view of the second embodiment with the signal panel being rotated from one signaling position to the other signaling position.

The second embodiment novel device also has means for releasably holding the signal panel in each of the two signalling positions 51C and 53C between the upper and lower flanges 27C and 29C by a press fit. The releasable holding means may be pairs of opposed bumps on the facing surfaces of one or both of the flanges and panel. As shown in FIGS. 6 to 10, the signal panel 31C has an upper bump 55C on its upper edge and a lower bump 57C on its lower edge which bear against the facing surfaces of the upper and lower flanges 27C and 29C respectively in each of the first and second positions 51C and 53C respectively, as shown in FIGS. 6 to 10. There are also opposed flange bumps 89 and 91 on the upper and lower flanges 27C and 29C adjacent the pivot slots 81 and 83 respectively facing the intermediate panel edges 65C and 67C in each of the first and second signalling positions 51C and 53C respectively, as shown in FIG. 10.

The novel device also has a means for attaching the base plate 21C to the surface of a primary object, such as an office file, a file folder, a pill bottle, an item of manufacture, or of a similar article for which similar alternate information is desired. As shown in FIGS. 7 to 9, the back surface 25C of the base plate 21C carries a layer 69C of a pressure-sensitive adhesive. Other types of adhesive can be used instead. Also, the base plate 21C can include a clip, pin or staple instead of an adhesive, for attaching the novel device.

The base plate 21C and the signal panel are each made of a relatively rigid plastic material by any of the methods used for fabricating small items. The base plate 21C of this preferred embodiment is about 50 mm wide, 25 mm high and 2.5 mm thick. The flanges 27C and 29C are each about 2.5 mm high and stand out about 3.0 mm from the front surface 23C. The signal panel 31C is about 20 mm high, about 30 mm wide and 2.5 mm thick. Of course, the novel device can be made in other dimensions and other proportions.

It will be noted that the signal panel 31C covers a first area 71C or a second area 73C of the front surface 23C when the signal panel 31C is in its first and second signalling positions respectively. FIG. 10 shows, by the arrows 75C, the signal panel 31C being moved from its first position 51C to its second position 53C. Of course, the signal panel can be moved from its second position 53c to its first position 51C, and can be moved back and forth as many times as desired. In each position, the signal panel 31C is releasably held by a press fit occasioned by the mating pairs of bumps between the flanges 27C and 29C and the intermediate panel edges 65C and 67C.

The first and second areas 71C and 73C and/or the signal panel surfaces 32C and 34C have different contrasting colors such as red and green respectively, and/or may carry other contrasting signalling media, such as different letters, numbers or symbols, to indicate two different conditions or statuses as described above. In use, the second emmbodiment of the novel device is attached to the item of interest and the signal panel is flipped to a position so that the device indicates the desired condition or status. When the condition or status changes, the signal panel is flipped to the other position to indicate the change. The flip of the panel is accomplished without removing the device from the item and can be done manually wih the flip of a finger. The color fields, letters, numbers and/or symbols may be carried directly on the surfaces mentioned, or the surfaces mentioned may carry transparent pockets into which the desired information can be inserted and removed. Also, the surfaces mentioned can be adapted to receive a graphic notation applied by the user.

Unlike the first embodiment, the second embodiment shown in FIGS. 6 to 10 has the additional feature that the signal panel 31C may be pressed out of, or "popped out of," its pivotal mounting, and pressed or "popped into" its pivotal mounting. This feature results from the fact that the pivot slots 81 and 83 are open outwardly; that is, away from the front surface 23C of the base plate 21C. The pivot rods 85 and 87 are integral with the signal panel 31C and the pivot rods 85 and 87 are pressed into the pivot slots 81 an 83 respectively. With this feature, the signal panel 31C can be popped out of the device so as to display both of the first area 71C and the second area 73C of the front surface 23C at the same time. The original signal panel 31C can be popped back into the flanges 27C and 29C in the same orientation as, or inverted from, before, simply by pressing the pivot rods 85 and 87 into the pivot slots 81 and 83, or vice versa. Alternatively, another signal panel may be popped into the pivot slots 81 and 83 of the flanges 27C and 29C in the same manner. The other signal panel may have the same or different contrasting signalling media on the panel surfaces thereof.

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. A signal device adapted for use with a primary object comprising:

a generally rectangular base plate having a major plate surface, a pair of substantially parallel flanges upstanding along opposite edges of said major plate surface, a signal panel having two major opposed panel surfaces, said panel being pivotally mounted on said flanges and adapted to be rotated between two different signaling positions against said base plate between said flanges, means for releasably holding said signal panel in each of said two different positions against said base plate by a press fit between said flanges, and means for attaching said base plate to a primary object, such as an office file or the like.

2. The device defined in claim 1 wherein said releasable holding means includes said flanges and pairs of bumps on at least one intermediate edge of said panel and the adjacent flanges, said bumps being located to press fit said panel between said flanges when said signal panel is in each of said signalling positions.

3. The device defined in claim 2 wherein said panel has a pair of bumps and said flanges have a mating pair of detents in each of said signalling positions.

4. The device defined in claim 2 wherein said panel has a first pair of opposed bumps on the panel edges thereof opposite said flanges, and said flanges have a second opposed pair of bumps on the flange surfaces thereof opposite said panel edges when said signal panel is in each of said signalling positions.

5. The device defined in claim 1 wherein said attaching means is selected from the group consisting of a layer of pressure-sensitive adhesive on a surface of said base plate, a clip, a pin and a staple.

6. The device defined in claim 1 wherein said signal panel has a proximal edge and an opposite distal edge, said signal panel being pivotally mounted along said proximal edge to each of said flanges.

7. The device defined in claim 6 wherein said proximal edge of said signal panel is rounded to allow improved clearance when said signal panel is rotated between said signaling positions.

8. The device defined in claim 6 wherein said distal edge of said signal panel extends beyond the edge of said base plate when said signal panel is in either of said signaling positions.

9. The device defined in claim 1 wherein at least one of (a) the two areas of said plate surface covered by said signaling panel in said two signalling positions and (b) said two major signal panel surfaces themselves, have two contrasting signalling media selected from the group consisting of colors, words, letters, numbers, or symbols.

10. The device defined in claim 1 wherein said base plate and said signal panel are each constituted of a relatively rigid plastic material.

11. A signal device adapted for use with a primary object comprising:

a generally rectangular planar base plate having two major opposed plate surfaces, a pair of substantially parallel flanges integral with and upstanding along substantially the entire length of opposite edges of one of said major plate surface, a generally rectangular signal panel having major opposes panel surfaces, a proximal edge, a distal edge, and intermediate edges between said proximal edge and said distal edges, said panel being pivotally mounted along said proximal edge thereof to said flanges, said panel being of such dimensions as to fit between said flanges when said panel is pivotally rotated to each of two signaling positions adjacent said one of said major plate surfaces, means for releasably holding said panel in each of said signaling positions by press fit between said flanges, and means for attaching the other of said plate surfaces to a primary object, such as an office file or the like.

12. The signal device defined in claim 11 wherein said attaching means is a layer of pressure-sensitive adhesive coated on the other of said major plate surfaces.

13. The device defined in claim 11 wherein the distal edge of said signal panel extends beyond said base plate when it is in each of said signaling positions to permit easier digital engagement with said distal edge.

14. The device defined in claim 11 wherein the intermediate edges of said signal panel between said proximal edge and said distal edge thereof lie close to said flanges in each of said signaling positions, and said releasable holding means comprises mating bumps and detents in said flanges and said intermediate edges, which bumps and detents press fit said panel between said flanges in each of said signalling positions.

15. The device defined in claim 14 wherein said bumps extend outward from said intermediate edge into mating detents in said flanges when said signal panel is in either of said signaling positions.

16. The device defined in claim 15 wherein said flanges contain base slots adjacent to said base plate and terminating at the proximal edge of said signal panel.

17. The device defined in claim 11 wherein the intermediate edges of said signal panel between said proximal edge and the distal edge thereof lie close to said flanges in each of said signalling positions, and said releasable holding means comprises a first pair of opposed bumps on said intermediate panel edge opposite said flanges, and a second pair of bumps on the flange surfaces thereof opposite said intermediate panel edges, which bumps press fit said panel between said flanges in each of said signalling positions.

18. The device defined in claim 11 wherein said proximal edge is rounded to increase the clearance between said proximal edge and said base plate when said signal panel is rotated between said signaling positions.

19. The device defined in claim 11 wherein said pivotal mounting for said signal panel includes an aperture through said signal panel closely spaced from and substantially parallel to said proximal edge, an aperture in each of said flanges at about the middle of each of said flanges, a rod positioned in said panel aperture and said flange apertures, and means preventing said rod from moving out of said apertures.

20. The device defined in claim 11 wherein said pivotal mounting for said signal panel includes said flanges, each flange having a pivot slot therein at about the middle of said flanges, said pivot slots being opposite one another, a pivot rod integral with and extending from each of said intermediate panel edges adjacent to said proximal panel edge, each of said rods being press fit into and rotatable in a different one of said pivot slots, said pivot slots opening away from said one major plate surface, whereby said pivot rods maybe pressed out of and into said pivot slots.

21. The device defined in claim 11 wherein the base plate and said signal panel each consist essentially of a relatively rigid plastic material.

* * * * *